US005251830A

United States Patent [19]

Jiang

[11] Patent Number: 5,251,830

[45] Date of Patent: Oct. 12, 1993

[54] TUBE MILL

[75] Inventor: Yucan Jiang, Anhui, China

[73] Assignee: Hefei Cement Research & Design Institute Of State Administration Of Building Materials, Anhut, China

[21] Appl. No.: 795,186

[22] Filed: Nov. 12, 1991

[30] Foreign Application Priority Data

Nov. 13, 1990 [CN] China ..... 90109049.2

[51] Int. Cl.[5] ..... B02C 17/06

[52] U.S. Cl. ..... 241/72; 241/153; 241/183

[58] Field of Search ..... 241/72, 153, 171, 181, 241/183

[56] References Cited

U.S. PATENT DOCUMENTS

| | | | |
|---|---|---|---|
| 1,825,333 | 9/1931 | Catlin . | |
| 1,825,347 | 9/1931 | Gibson | 241/72 |
| 2,079,221 | 5/1937 | Miller et al. . | |
| 3,712,549 | 1/1973 | Cleemann | 241/72 X |
| 3,799,458 | 3/1974 | Lutke-Cossmann | 241/181 X |
| 4,083,500 | 4/1978 | Kartman | 241/72 X |
| 4,369,926 | 1/1983 | Rasmussen et al. | 241/72 X |
| 5,056,722 | 10/1991 | Michelsen et al. | 241/181 |

FOREIGN PATENT DOCUMENTS

| | | | |
|---|---|---|---|
| 8510678 | 1/1987 | China . | |
| 549694 | 5/1932 | Fed. Rep. of Germany . | |
| 562235 | 11/1923 | France . | |
| 1378915 | 3/1988 | U.S.S.R. | 241/72 |
| 1583167 | 8/1990 | U.S.S.R. | 241/72 |
| 387407 | 5/1932 | United Kingdom . | |

*Primary Examiner*—Mark Rosenbaum
*Assistant Examiner*—Frances Chin
*Attorney, Agent, or Firm*—Ladas & Parry

[57] ABSTRACT

A tube mill comprises a coarse grinding compartment and two or three independent fine grinding compartments. Material fed into the mill is first ground by a coarse grinding compartment and then shunted into two or three portions which are conveyed into each corresponding fine grinding compartment. The mill of the invention has resolved the problems of overgrinding and unmatched grinding capability in each compartment of conventional tube mill, and increase output and decrease power consumption greately, so as to become a high eficiency mill. Further, the tube mill of the invention has the advantages of simple structure, ease for operation and low investment. It can be adapted for both reformation of prior tube mill and construction of new tube mill.

14 Claims, 9 Drawing Sheets

TUBE MILL

The invention relates to a milling apparatus, particularly, to a tube mill which can be widely used for milling architectural materials, metals, chemicals, cement, etc.

So far, the disadvantages of a one stage open circuit tube mill have that output and grain size of the product manufactured by such tube mill are limited because of the limitation of the inner structure of such mill. Especially, when the specific surface area of the product is larger than 3000 $cm^2/g$, the output of the mill is decreased greatly, and power consumption is increased greatly. Moreover, the disadvantage of a one stage open circuit tube mill, i.e. low output and high power consumption, will still exist even if the mill is used for milling out product with specific surface area less than 3000 $cm^2/g$.

Conventional one stage open circuit tube milling always comprises, no matter how many grinding compartments the mill has, the steps of feeding material from the feeding port, successive grinding in such grinding compartment and discharging product from the last compartment. The grading of grinding bodies in each compartment depends upon the grain size and behaviour of the material to be ground. For example, big steel balls are used for a first grinding compartment, small steel balls or big steel cylpeb for a second one, and small steel cylpeb for a third one, etc. However, the grinding capabilities of different kinds of grinding bodies are different. For example, big steel ball has higher grinding capability, but it can not grind the material into very fine material. Small cylpeb has lower grinding capability, but it can grind the material with corresponding grain size into very fine material. Since the grinding capabilities of different grinding bodies are different, the grinding capabilities in each compartment of conventional one stage open circuit tube mill is different, i.e. the first compartment has highest grinding efficiency per unit volume of the mill; the second compartment takes the second place, and the third one has the lowest efficiency, which results in relative surplus of grinding capability, in the compartment having higher grinding capability. This is one of the important reasons why conventional one stage open circuit tube mill has disadvantages of low output and high power consumption.

Further investigation also shows that the length of each compartment of the mill should satisfy certain requirements so as to grind feed material with a certain grain size into a specific fineness. Generally, the longer the compartment is, the finer the ground material is. Therefore, a specific length is required for a specific compartment, in order to guarantee the distribution of the fineness of the material from said specific compartment. However, it is difficult to adjust the length of each compartment to obtain suitable grinding capability, so it results that the total length of the mill is increased, and the output per unit volume is low.

Moreover, the distribution of the material grain size during grinding over a range according to grinding theory, so one of the key technique to avoid overgrinding is that the material which has grain size adapted for next compartment must be screened out in time. Therefore, the grading means should meet higher requirement. In general, it is difficult to screen out very fine material directly by conventional grading means such as by a conventional diaphragm and grate, so it is difficult to guarantee the fineness of the material fed into downstream compartment, and output of the ground material. A grading means disclosed by Chinese Patent CN 85106781 has provided active action to solve the problem.

The object of the invention is to provide a tube mill with a new structure, wherein a material shunting means is provided in the mill, and the internal structure, disposition of compartments and grading of grinding bodies are rearranged so as to make grinding capabilities of each compartment adaptable to each other, to reduce overgrinding of material, avoid insufficient grinding capability, to increase output per unit volume of the mill greatly and reduce power consumption per unit product. In the case that suitable grading means is used, the invention might result high output and superfineness. Further, the structure of the mill is relatively simple, which may be adapted for both reformation of pre-existing tube mill and construction of new tube mill. Moreover, the mill according to the invention has advantages such as compact structure, stable and reliable work, and ease for operation erection and maintenance.

The invention is based on a series of investigations on grinding capabilities and effects of each compartment in conventional tube mills. It has been found that the first compartment using the big ball has higher grinding capabilities, however, a certain length is required for the first compartment in order to guarantee the fineness of the material from the first compartment, thus resulting in a surplus of grinding capability of the first compartment. But the downstream compartments using smaller grinding bodies have relatively insufficient grinding capability. On the other hand, it is further found, through an investigation of CN 85106781 and conventional tube mills, that by using suitable grading means and suitable grading of grinding bodies, the combination of one course grinding compartment and one fine grinding compartment is enough for obtaining fineness of ground material which can meet the technical requirement. For example, when grinding cement by the mill according to CN 85106781, the specific surface area of material from the second compartment is more than 3000 $cm^2/g$. The effect of the downstream compartments which take up more than half of the total length of the mill is only to increase the specific surface area of the ground material from 3000 $cm^2/g$ to more than 4000 $cm^2/g$. Therefore, grinding by two compartments is enough for grinding out material with conventional fineness.

Based on the above analysis, according to the invention, a grading grinding in the mill has been performed by means of changing the inner structure and the disposition of compartments and suitable grading of the grinding bodies has been selected so as to make grinding volume effectively useful and grinding efficiency increased, thus realizing the object of the invention, i.e. increasing output of the mill greatly, and deceasing power consumption per unit product greatly.

The tube mill according to the invention has a structure of multi-compartments. Based on the principle that the size and configuration of grinding bodies should correspond to the grain size of material to be ground, big balls having the highest grinding capability are used in the coarse grinding compartment. The remaining grinding portion downstream of the coarse grinding compartment is divided into two or three juxtaposed fine grinding compartments which are independent to each other and have similar action. The material from the coarse grinding compartment is conveyed into respective fine grinding compartments. For the fine grinding compartment which is adjacent to the coarse grinding compartment, the material is fed into it directly. For fine grinding compartments which are not adjacent to the coarse grinding compartment, the material is fed by conveying means, such as reamer or the like. Similarly, the material which has been ground in each fine grinding compartment is discharged out of the mill. The material from the fine grinding compartment which is adjacent to output port is discharged out directly by the discharging means, but material from the fine grinding compartment which is not adjacent to output port is discharged to the output port by conveying means such as reamer and the like or discharged out of the mill by an intermediate discharging means.

A further improvement of the invention is that grading means is provided in the mill, correspondingly, the disposition of each compartment and the direction of material flow is adjusted. A direct improvement is the grain size of material from coarse grinding compartment is defined by a grading means which is disposed behind coarse grinding compartment and grades the material from coarse grinding compartment.

The material from the coarse grinding compartment is graded by grading means into two portions: one is finer material passing through the grading means and another is coarser material which can not pass through the grading means. There is different processing for said two portions of material: one process is returning coarse material directly into the coarse grinding compartment, and separating finer material into two or three portions and conveying them into each downstream fine grinding compartment; the other is conveying coarser material into a fine grinding compartment, and finer material into another grinding compartment. In latter processing, two fine grinding compartments are provided.

Each fine grinding compartment can be subdivided by diaphram and grading means according to requirement, i.e. grading grinding is performed in fine grinding compartments. For example, a transition grinding compartment is formed at the upstream portion of fine grinding compartment by a diaphragm and grading means, and bigger grinding bodies are used in the transition grinding compartment. Generally, it is decided according to concrete condition whether transition compartment is disposed in a fine grinding compartment or transition compartment is disposed in all fine grinding compartments. For example, if coarser material is conveyed into one fine grinding compartment and finer material is conveyed into another one, the transition compartment might be disposed only in former compartment.

On the other hand, if necessary, a diaphram might be disposed in the coarse grinding compartment in the mill according to the invention to separate the compartment so as to perform grading grinding. In such case, grading grinding might be realized only by a diaphram, instead of specific grading means because the material grain in coarse grinding compartment is coarser.

The advantages of the invention are as follows:

1. Since the utilization of effective space of the mill and grading effect of mill is increased, especially, the match of grinding efficiencies between compartment is improved, thus increasing output per unit product greatly. As compared with conventional one stage open circuit tube mill, in the case that the products have identical fineness, the output per unit volume might be increased greatly and power consumption per unit product is decreased greatly. For example, when grinding cement by the mill of the invention, power consumption per product is reduced by 20 kilowatt-hours. It is great significance for saving energy, releasing the tension of electric power, and increasing economical benefits.

2. Many kinds of grading means can be easily used in each grinding compartment of the mill according to the invention to preform grading grinding, so as to increase grinding efficiency in each compartment. Moreover, it has been proved via experiments that superfine grinding may be realized according to the invention through the changing diaphram, grate, size and configuration of the screen openings of grading means, as well as the adjustment of grading of grinding bodies correspondingly. The fineness of the product is similar to that of CN 85106781, but output and power consumption are better than those of CN 85106781.

3. Since the invention is based on reformation on inner structure of conventional one stage open circuit tube mill, the invention still has the advantages of said conventional mill, i.e. simple process, easy to operate and low investment, but overcomes the disadvantages of high power consumption per unit product and low output per volume mill existing all in conventional one stage open circuit tube mill, thus providing a new way to use and develop one stage open circuit tube mill.

4. Combination of one coarse grinding compartment and two or three independent fine grinding compartments might be used for not only said one stage open circuit tube mill but also closed circuit mill and the like to increase output of the mill and decrease power consumption per unit product.

The invention will be described in detail through the embodiments accompanying the attached drawings, wherein.

Figure 1:
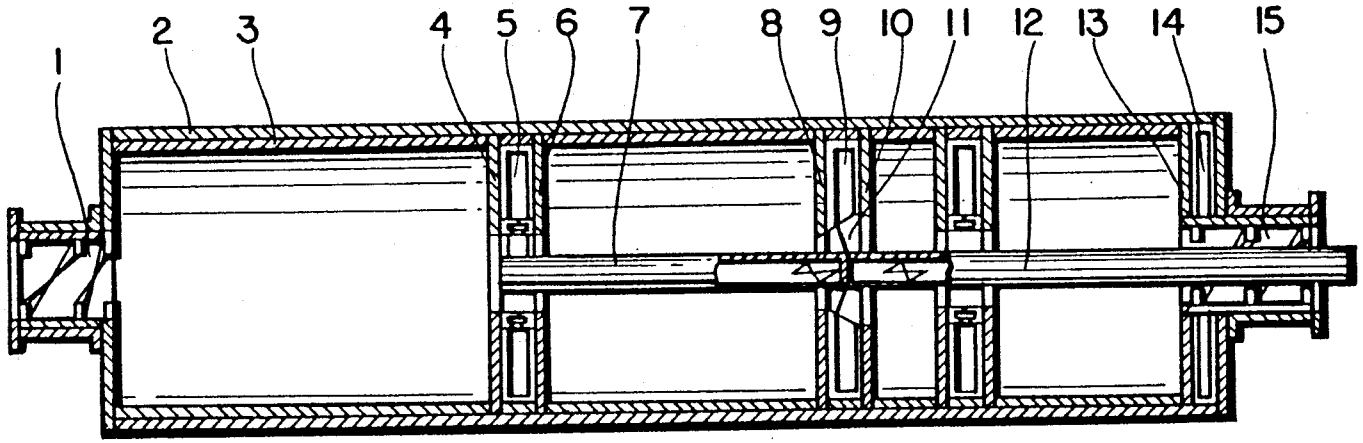
FIG. 1 is a schematic view showing the structure of the tube mill according to the invention.

The invention is an improvement on conventional tube mill. Referring now to FIG. 1, as conventional, the tube mill comprises feed port 1, output port 15, cylindrical body 2, lining 3 and milling material etc. This improved tube mill is, however, divided into several compartments by partition means. Material to be ground is fed from the feed port into the mill, and is then coarsely crushed or ground by grinding bodies (generally, big steel balls) in the coarse grinding compartment at the feed port.

The space downstream of the coarse grinding compartment is divided into two or three, but here as in general, two independent fine grinding compartments by the partition means. As shown in FIG. 1, the two fine grinding compartments are separated by a first diaphram 4 and a first blind plate 6. The material from the coarse grinding compartment is conveyed into each of the fine grinding compartments via material shunting means 5 disposed between the coarse grinding compartment and the first fine grinding compartment. Shunting means 5 comprises a plurality of lifters. The material from the coarse grinding compartment is divided into two portions by the shunting means, one portion being conveyed into the first fine grinding compartment and the other being conveyed into the second fine grinding compartment via first internal screw conveyer 7. On the other hand, qualified finished product from the first fine grinding compartment is conveyed to the output port 15 via a second internal screw conveyer 12 without passing through the second fine grinding compartment, and qualified finished product from the second fine grinding compartment passes through an outlet grate 13 and by a lifter 14 to the output port 15.

Figure 2:
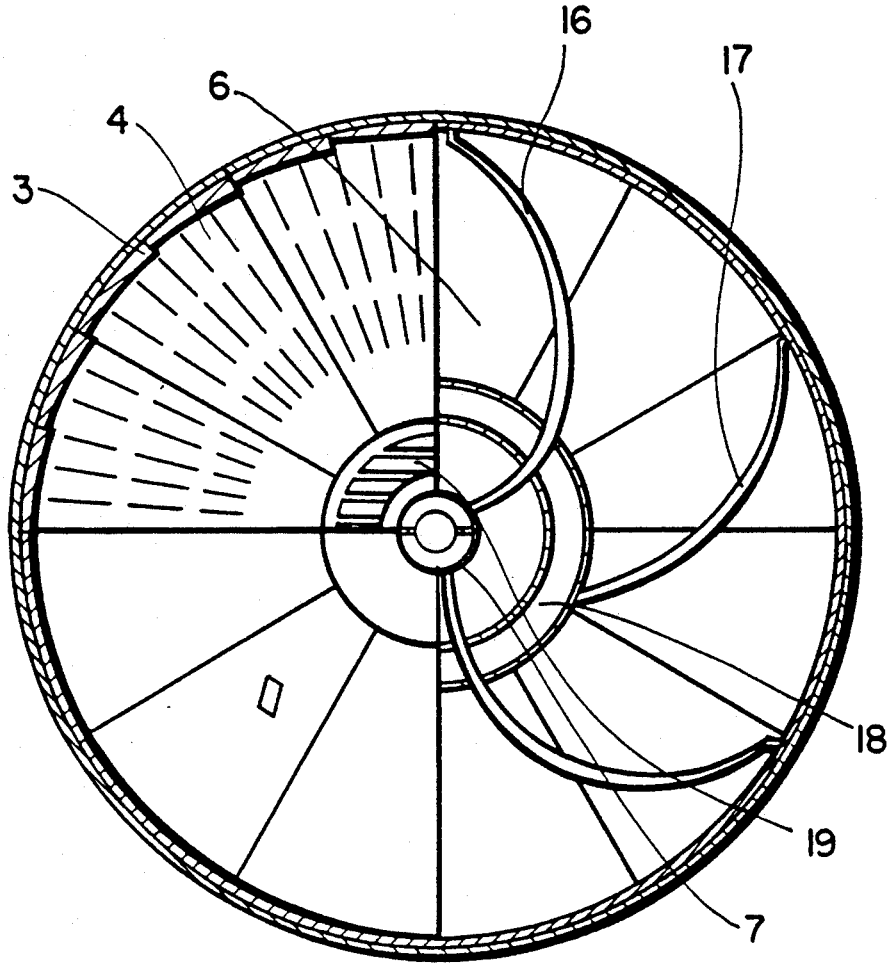
FIG. 2 is a schematic view showing the material shunting means in FIG. 1.
Figure 3:
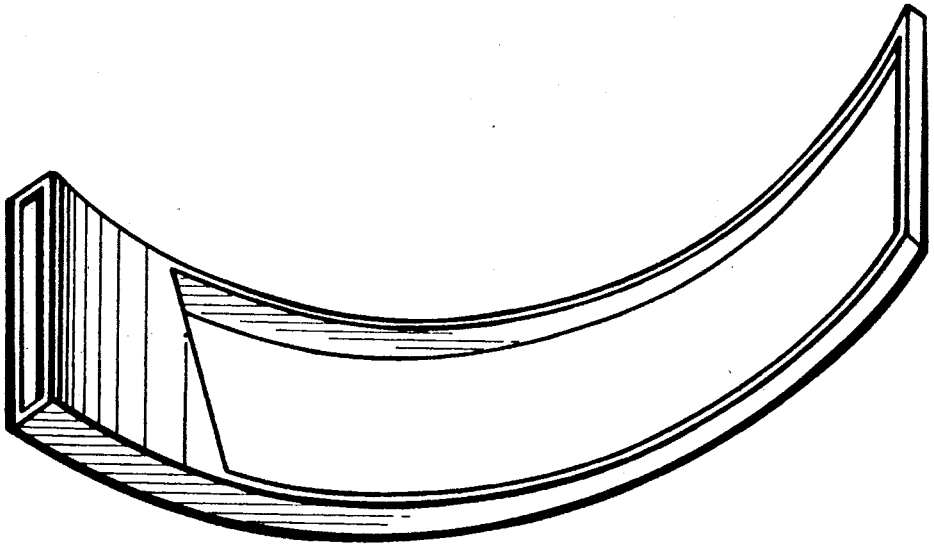
FIG. 3 is a prespective view of the lifter according to the invention.

FIG. 2 shows detail structure of the material shunting means 5, wherein a ventilation grate 19 is disposed outside the first internal screw conveyer 7 and is fixed by central cylindrical body 18, which is preferred to have a form of hollow wall, i.e. it is formed by two coaxially disposed cylinders with different diameters made by rolling up steel sheets. The two ends of the central cylindrical body 18 are sealed by two annular steel sheets, respectively. Moreover, a first partition 4 and a first blind plate 6 are fixed to the two ends of the central cylindrical body 18 respectively by long bolts. FIG. 3 shows a perspective view of the first lifter 16 according to the invention, wherein the upper portion is a trough shaped lifter or a conventional one, and the lower portion takes the form of a conveying tube, but the second lifter 17 is a conventional one. When in use, equal numbers of the lifter 16 with conveying tube and conventional lifter 17 are spaced apart. The end of the upper portion of the first lifter 16 is fixed to the lining 3 of the cylindrical body 2, and the conveying tube in the lower portion of the lifter 16 passes through the central cylindrical body 18 and communicates with the first internal screw conveyer 7. The end of the upper portion of the second lifter 17 is also fixed to the lining 3, but the end of the lower portion of the second lifter 17 is fixed to the outside of the central cylindrical body 18. Each second lifter 17 corresponds with one discharging opening in the first blind plate. The material shovelled by the first lifter 16 is conveyed to the internal screw conveyer 7 via the conveying tube at the lower portion of the first lifter 16 and then to the second fine grinding compartment via the first internal screw conveyer 7, and the material shovelled by second lifter 17 is conveyed to the first fine grinding compartment via the discharge openings of the first blind plate 6.

Figure 4:
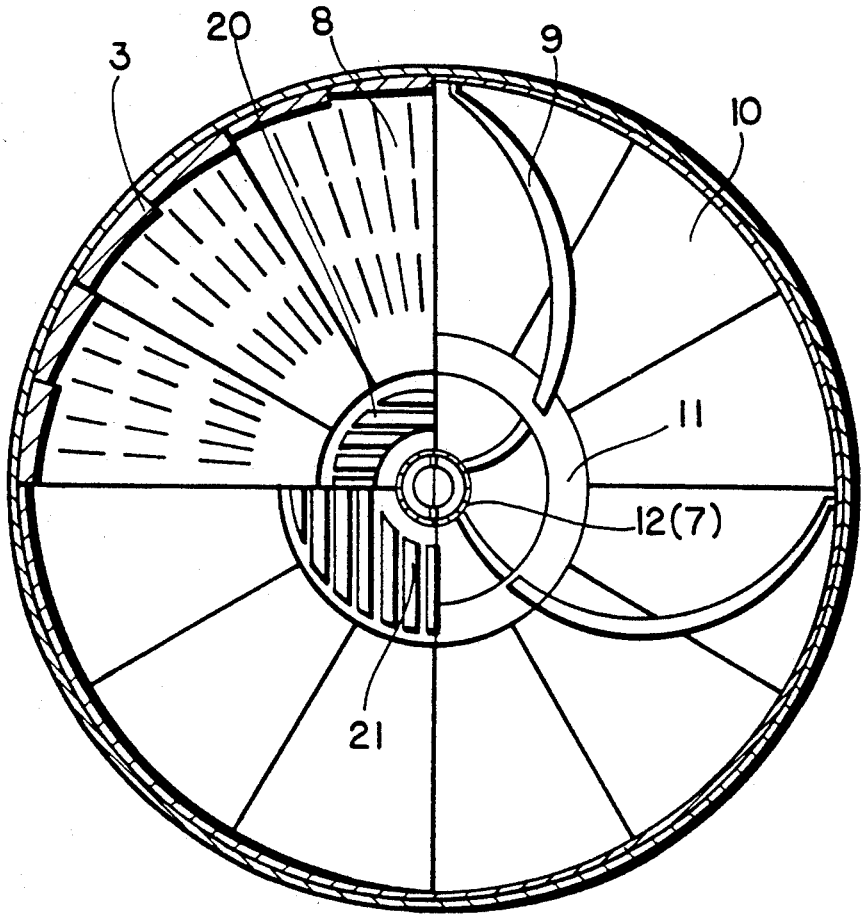
FIG. 4 is a schematic view showing connecting manner of two fine grinding compartments in FIG. 1.
Figure 5:
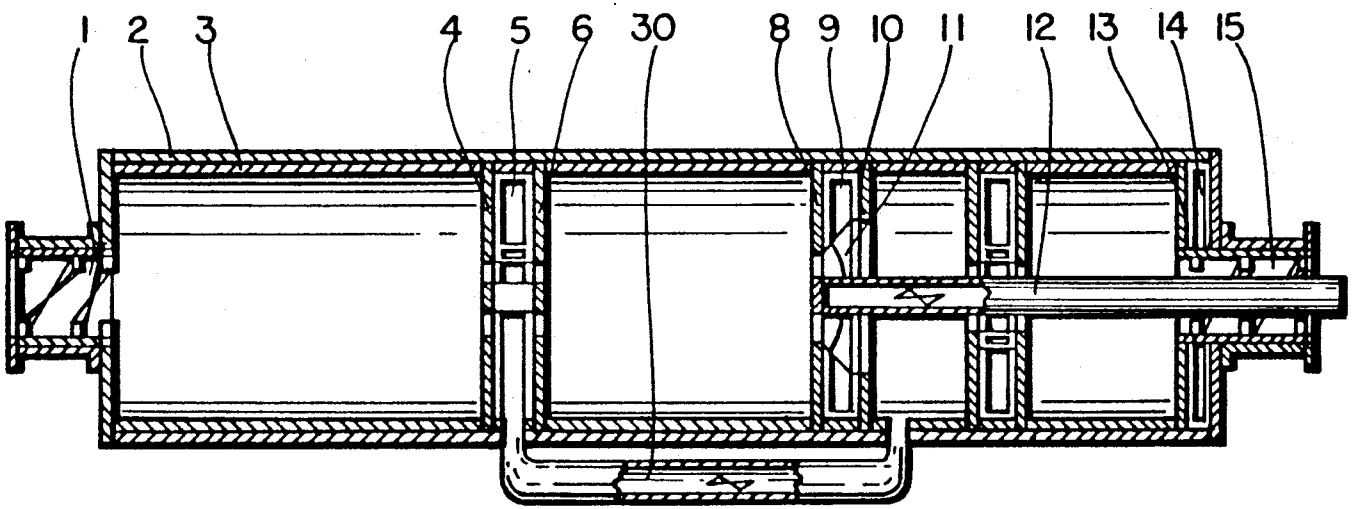
FIG. 5 is a schematic view showing the U screw conveyer according to the invention.

FIG. 4 shows connecting structure between first and second fine grinding compartments, wherein a duplex-layer compartment is formed by the second diaphragm 8 and the second blind plate 10, and the first internal screw conveyer 7 and the second internal screw conveyer 12, which are not communicated with each other directly, are converged to said duplex-layer compartment. Further, a discharge cone 11 which is formed by rolling up a sectorial steel and has a configuration of a hollow truncated cone is provided in the duplex-layer compartment. A ventilation grate 20 is fixed to the top of the cone 11, and a ventilation grate 21 is fixed to the bottom of the cone 11. A second diaphragm 8 is provided outside the ventilation grate 20, and a second blind plate 10 is provided outside the ventilation grate 21. The second diaphragm 8 and the second blind plate 10 are held together by long bolts. Another lifter 9 which has a similar configuration as shown in FIG. 3 is provided between the second partition 8 and the second blind plate 10. The lower portion of the another lifter 9 takes a form of conveying tube, which passes through the cone 11 and communicates with the second screw conveyer 12. Moreover, at the tail portion of the first internal screw conveyer 7 behind the ventilation grate 20 is provided with a discharging opening. When in operation, the material from the first fine grinding compartment is conveyed into the duplex layer compartment via the second diaphragm 8, and is shovelled by the another lifter 9 in the duplex-layer compartment, and then conveyed to the second screw conveyer 12 through the conveying tube in the tail portion of the another lifter 9, and then discharged out of the mill. The material conveyed by the first internal screw conveyer 7 is discharged to inner side of the cone 11 through the discharging opening provided at the tail portion of the first internal screw conveyer 7, and then conveyed to the second fine grinding compartment via the grate opening in the ventilation grate 21. In another embodiment if the invention, instead of being conveyed to output port 15 via the second internal screw conveyer 12, the material from the first fine grinding compartment may be discharged out from the intermediate discharging opening provided on the cylindrical body 2 between the second diaphragm 8 and the second blind plate 10. In such case, the second internal screw conveyer 12 is not needed, and a conventional lifter, instead of the another lifter 9, can be used. It should be noted that the first and second internal screw conveyer 7, 12 may take both the form of that show in the figures which is provided inside the mill, and the form of " " screw conveyer provided outside the mill, and the two ends of the screw conveyer are communicated with the two duplex-layer compartments within the mill respectively. FIG. 5 shows that an U shaped internal screw conveyer 30 is used to replace the internal screw conveyer 7.

Figure 6:
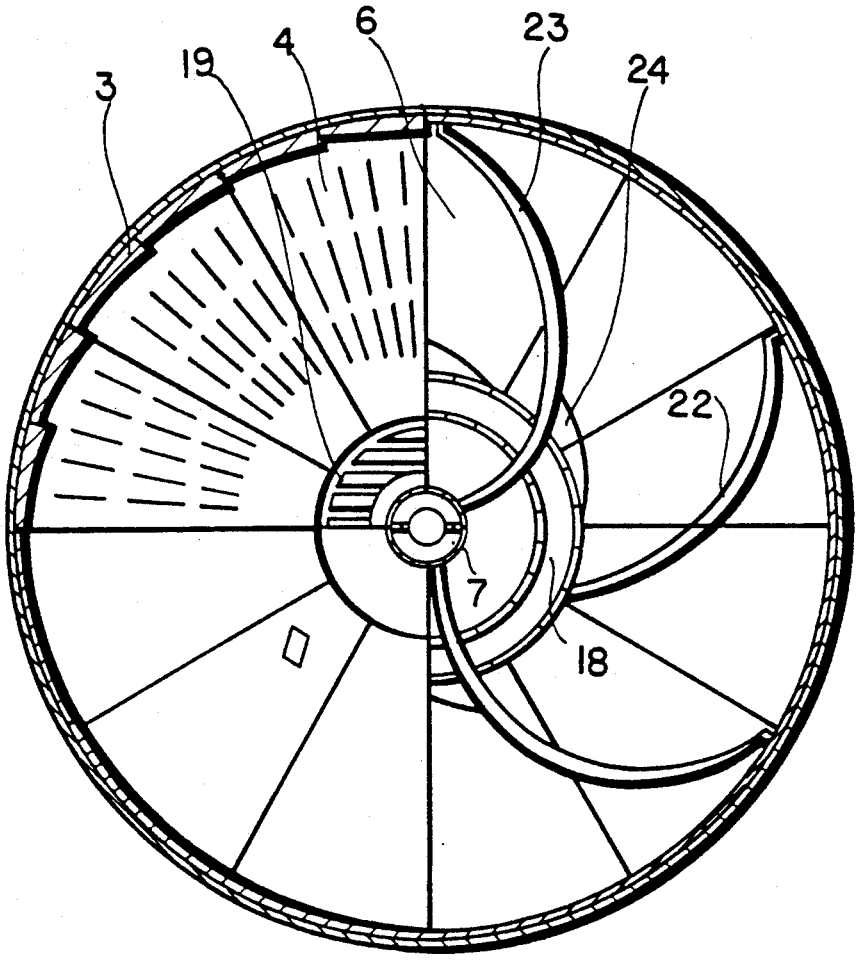
FIG. 6 is a schematic view showing another material shunting means according to the invention.

In order to control the grain size of materials conveyed into the fine grinding compartment, first lifter 16 and second lifter 17 of the material shunting means 15 may be modified to the lifters with screen (i.e. duplex-layer arcuate separating screen). The structure of said screen is as shown in CN 85106781. In such case, the main structure of the mill is still as shown in FIG. 1 except that the structure of the material shunting means is as that shown in FIG. 6. The difference between the shunting means shown in FIG. 6 and FIG. 2 lies in that, instead of first lifter 16 and second lifter 17, there are used first and second duplex-layer arcuate separating secreens 22 and 23, wherein the lower portion of first screen 22 which has a discharging opening is fixed to outside of the central cylindrical body 18, and the lower portion of second screen 23 is a conveying tube, which passes through the central cylindrical body 18 and is communicate with the first internal conveyer 7. Further, a guide plate 24 is provided between each pair of adjacent arcuate screens During the rotation of the tube mill, the coarse material which can't pass through the duplex-layer arcuate separating screens 22 and 23 is accumulated at the guide plate 24 where the accumulated material will slide by means of the inclined face of the guide plate 24 to ventilation openings on the ventilation grate 19 provided on the diaphragm 8. so as to return the coarse material to the coarse grinding compartment. The fine material passing through the first acruate screen 22 is discharged to the first fine grinding compartment via the discharging opening provided at the screen, and the discharging opening at the blind plate 10 and fine material passing through the second arcuate screen 23 is conveyed to the first screw conveyer 7 via the conveying tube at the lower portion of the second screen 23 and then conveyed into the second fine grinding compartment via the first internal screw conveyer 7.

Figure 7:
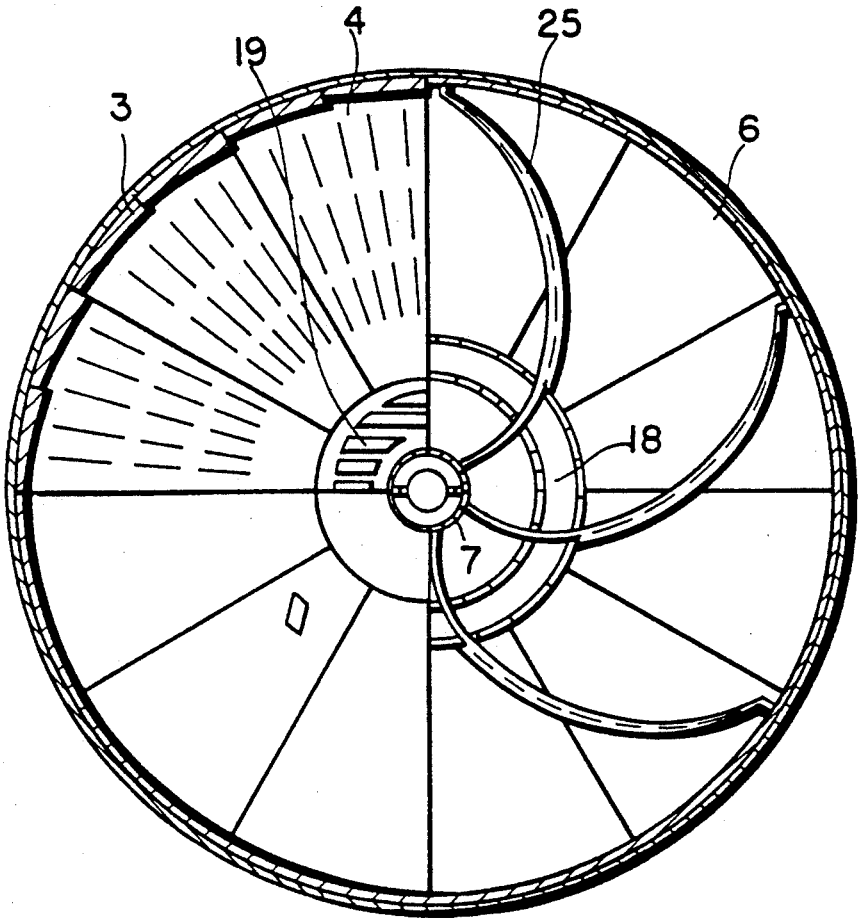
FIG. 7 is a schematic view showing further material shunting means according to the invention.

For the material shunting means 5 in the form of duplex-layer arcuate separating screen, there is another method to process the material from the coarse grinding compartment. That is to say, the material from the coarse grinding compartment is divided into fine material which can passes through the duplex-layer arcuate separating screen, and coarse material which can not passes through the duplex-layer arcuate separating screen. In such case, the main structure of the mill is still as shown in FIG. 1, except that the structure of the material shunting means is as that shown in FIG. 7. The end of the upper portion of two layered arcuate separating screen 25 is fixed to the lining 3 of the cylindrical body of the mill. The lower portion of the screen 25 is a conveying tube which passes through the central cylindrical body 18 and is communicated with the first internal screw conveyer 7. FIG. 7 shows the structure of the duplex-layer arucate separating screen into which coarse material is conveyed to the first conveyer 7 via the conveying tube of the screen. However, fine material may also conveyed into the first internal screw conveyer 7 by means of the structure of second duplex-layer arcuate separating screen 23 as shown in FIG. 5, and the remainder is directly discharged into the first fine grinding compartment through discharge opening provided at the first blind plate 6. Generally speaking, among the method for conveying coarse and fine materials into different fine grinding compartments, the fine grinding compartment grinding coarse material should be longer than that grinding *fine* material so as to produce material with similar grain size.

Figure 8:
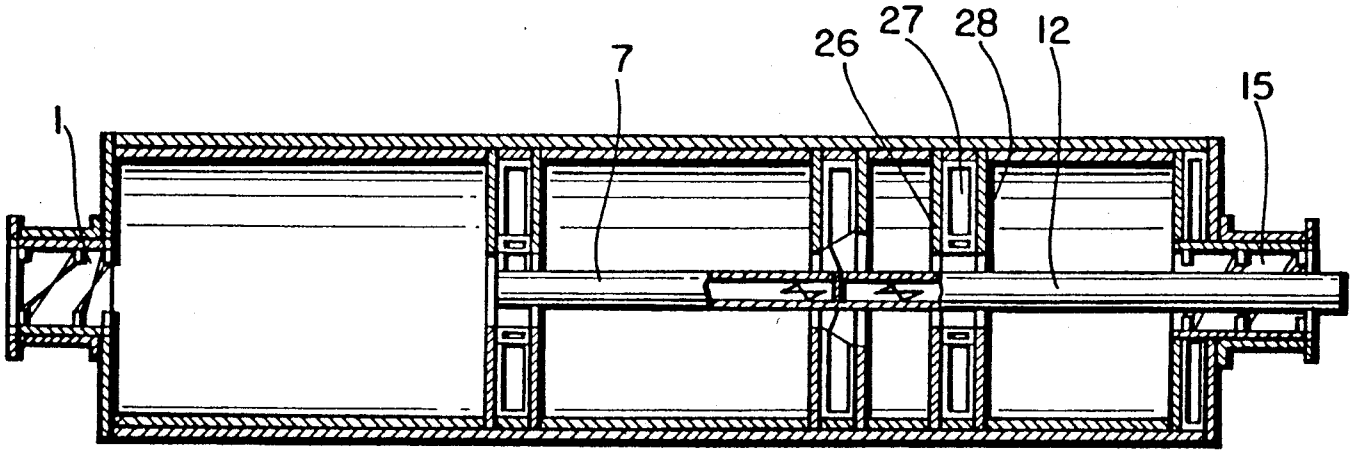
FIG. 8 shows an improved structure of the invention.

Based on the principle of that grading grinding may improve the efficiency of mill, the fine grinding compartments of the mill according to the invention may be subdivided so as to realize grading grinding. It is particularly adapted for fine grinding compartment for grinding coaser material. Generally, grading grinding is the fine grinding compartment is performed according to practical need, and it may be performed both in all fine grinding compartments and in part of them. For the material shunting means as shown in FIG. 7, wherein coarser and finer materials are conveyed into different fine grinding compartment respectively, the grading grinding may be performed in the fine grinding compartment for coarser material. The technical scheme shown in FIG. 8 corresponds to the shunting means shown in FIG. 7, that is to say, the second fine grinding compartment is used as one for grinding coarser material, and in said compartment the grading grinding is performed. The concrete structural arrangement may be as follows: A transition grinding compartment is formed in upstream section of the second fine grinding compartment by subdividing the second fine grinding compartment with another diaphragm or grate 26, and larger grinding bodies are used in the transition grinding compartment. In order to intensify the effect of the grading grinding, a grading means 27 may be provided behind diaphragm or grate 26, and a blind plate 28 is provided to separate the grading means from downstream portion of the second fine grinding compartment. It is preferred to use duplex-layer arcuate separating screen as the grading means, thus returning material which can not pass through the grading means into the transition grinding compartment and conveying material which passes through the grading means into downstream portion of the second fine grinding compartment.

Figure 9:
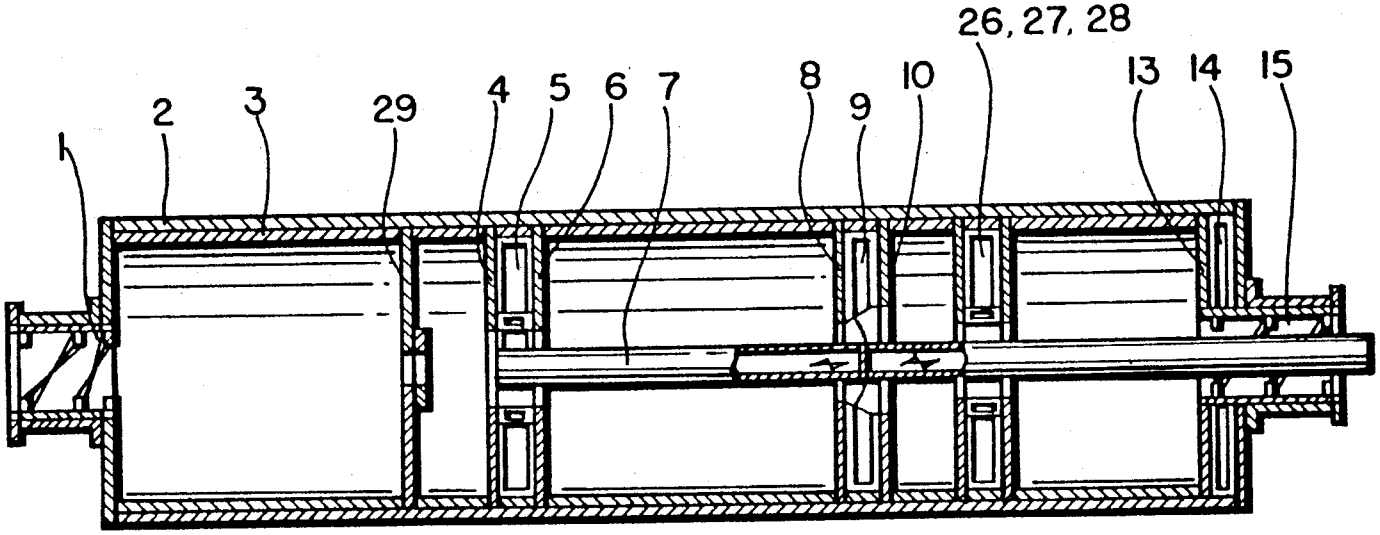
FIG. 9 shows further improved structure of the invention.

Further, the grading grinding may be also performed in coarse grinding compartment, as shown in FIG. 9. That is to subdivide the coarse grinding compartment into two sub-compartments (or three sub-compartments, if necessary), and grinding bodies with different size are used in each sub-compartments. Generally, larger grinding bodies are used in upstream portion of the compartment, and smaller grinding bodies are used in downstream portion of the compartment. Since the grain size of the material in coarse grinding compartment is coaser, single diaphragm (29) is enough to perform the grading grinding. However, the grading means, such as duplex-layer arcuate separating screen, may also be used in coarse grinding compartment.

I claim:

1. A one stage open circuit tube mill comprising a cylindrical body, a lining, grinding body, a feed port, an output port, a first partition means and a second partition means provided to separate the cylindrical body longitudinally into a coarse grinding compartment which is in communication with the feed port, a first fine grinding compartment being next to said first partition means, and a second fine grinding compartment which is in communication with the output port, wherein the operation of the first and second fine compartment is in parallel, a material shunting means comprising a plurality of lifters being provided in the first partition means which shunts the material from the coarse grinding compartment into two portions, one being directly conveyed into the first fine grinding compartment and the other being conveyed into the second fine grinding compartment via a first conveying means, the material from the second fine grinding compartment being discharged directly out of the mill, and a second conveying means being provided to convey and discharge the material from the first fine grinding compartment to outside of the mill without passing through the second fine grinding compartment.

2. The tube mill according to claim 1, wherein said first conveying means and said second conveying means are respectively a first internal screw conveyer and a second internal screw conveyer being respectively provided longitudinally at the center portion of said first and second fine grinding compartments, the first internal screw conveyer and the second internal screw conveyer, which are not communication with each other directly but converge to said second partition means.

3. The tube mill according to claim 2, wherein said first partition means comprises a first draphram and a first blind plate, the first diaphram being provided with a first screen, through which the material from the coarse grinding compartment is conveyed into the first partition means, and a plurality of first discharge openings being provided in the first blind plate and communication with the first fine grinding compartment.

4. The tube mill according to claim 3, wherein said lifters comprises a plurality of first lifters, a plurality of second lifters and said shunting means further comprises a central cylindrical body being provided outside of the first internal screw conveyer in a substantially concentric manner, said first and second lifters having their lower ends fixed to the outside of the central cylindrical body in a radial-spaced manner, and their upper ends fixed to the inside of the lining of the mill; said first lifters being trough shaped with a conveying tube at each of their lower portions, said conveying tube passing through the central cylindrical body and communicating with the first internal screw conveyer, the material shovelled by the first lifters being thus conveyed to the first internal screw conveyer; each of said second lifters having their lower ends fixed to the outside of the central cylindrical body, each of said second lifters corresponding with each of a first discharge openings in the first blind plate, thus the material is shovelled by the second lifters being conveyed into the first fine grinding compartment through said first discharging opening.

5. The tube mill according to claim 3, wherein said lifters comprises a plurality of first duplex-layer arcuate separating screens and a plurality of second duplex-layer arcuate separating screens and said shunting means further comprises a central cylindrical body being provided on the outside of said first internal screw conveyer in a substantially concentric manner; said first and second duplex-layer arcuate separating screens having their lower ends fixed to the outside of the central cylindrical body in a radial-spaced manner, and their upper ends fixed to the side of the lining of the mill; a plurality of guide plates being provided respectively between each pair of first and second duplex-layer arcuate separating screens to return the coarser material which can't pass through the first and the second duplex-layer arcuate separating screens into the coarse grinding compartment; each of said second duplex-layer arcuate separating screens having at its lower portion a conveying tube which passes through the central cylindrical body to communicate with said first screw conveyer thus conveying the finer material from the second duplex-layer arcuate separating screens into the first internal screw conveyer; each of the first duplex-layer arcuate separating screens has a discharge opening on its lower portion communicating with said first discharge opening of the first blind plate to make the finer material from the first duplex-layer arcuate separating screen be conveyed into the first fine grinding compartment.

6. The tube mill according to claim 3, wherein said lifters comprises a plurality of third duplex-layer arcuate separating screens and said shunting means further comprises a central cylindrical body being provided on the outside of the first internal screw conveyer in a substantially concentric manner, said third duplex-layer arcuate separating screens having their lower ends fixed to the outside of the central cylindrical body, and their upper ends fixed to the inside of the lining of the mill; each of said third duplex-layer arcuate having at its lower portion a conveying tube which passes the central cylindrical body and is in communication with the first internal screw conveyer to convey the finer material from the third duplex layer arcuate screens through said conveying tubes into a first internal screw conveyer, and then fed into the second fine grinding compartment via the first internal screw conveyer; and the coarser material which can't passes through the third duplex-layer arcuate separating screens being conveyed into the first fine grinding compartment via the discharge opening at the first blind plate, and the material which is ground in the first and the second fine gringing compartments being discharged directly out of the compartments.

7. The tube mill according to claim 3, wherein said lifters comprises a plurality of fourth duplex-layer arcuate separating screens and said shunting means further comprises a central cylindrical body being provided on the outside of the first internal screw conveyer in a substantially concentric manner, said fourth duplex-layer arcuate separating screen having their lower ends fixed to the outside of the central cylindrical body, and their upper ends fixed to the inside of the lining of the mill; each of said fourth duplex-layer arcuate separating screens having at its lower portion a conveying tube which passes the central cylinder body and is in communication with the first screw conveyer to convey the coarser material which can't passes through the fourth duplex-layer arcuate separating screens through said conveying tube into the first internal screw conveyer and then fed into the second fine grinding compartment via the first internal screw conveyer; the finer material from the fouth duplex-layer arcuate separating screens into the first fine grinding compartment via the first discharge opening at the first blind plate, and the material which is ground in the first and the second fine grinding compartments being discharged directly out of the compartments.

8. The tube mill according to claim 2, wherein said second partition means comprises a second diaphram and a second blind plate, said second diaphram being provided with a second screen, through which the material from the first fine grinding compartment is conveyed into the second partition means, said second blind plate being provided with a second discharge opening; said second partition means being further provided with a plurality of third lifters, a discharge cone which is provided on the outside of the place where the first and second screw conveyers are converged in a substantially concentric manner; said third lifters having their lower ends fixed to the outside of the central cylindrical body and their upper ends fixed to the inside of the lining of the mill; each of the said third lifters having a lower end comprising a conveying tube which passes through the discharge cone to communicate with said second internal screw conveyer thus conveying the material from the first fine grinding compartment through side conveying tube into the second internal conveyer; a discharge opening of the first internal screw conveyer being provided inside of the discharge cone, the inner side of the discharge cone being used to make the material from the first internal screw conveyer be conveyed into the second fine grinding compartment via the second discharge opening at the second blind plate.

9. The tube mill according to claim 1, wherein said first conveying means is a first internal screw conveyer and said second conveying means is a discharge opening being provided on the cylinder body at the second partition means.

10. The tube mill according to claim 1, wherein said first conveying means is a "U" shaped conveying tube being provided on the outside of the cylindrical body of the mill and being provided with an opening on the cylindrical body, the first partition means being in communication with the second fine grinding compartments via the "U" shaped tube.

11. The tube mill according to claim 1, wherein said coarse grinding compartment is provided with a fouth diaphram to separate the coarse grinding compartment into two sub-grinding compartments.

12. The tube mill according to claim 1, wherein a third partition means is provided at upstream of least one of said fine grinding compartment to form a transition grinding compartment to carry out a grading grinding.

13. The tube mill according to claim 12, wherein said third partition means comprises a third diapharam and a third blind plate, and a screen means is provided in the third partition means.

14. The tube mill according to claim 13, wherein said screen means is duplex-layer arcuate separating screen.

* * * * *